US005534890A

United States Patent [19]

Krug et al.

[11] Patent Number: 5,534,890

[45] Date of Patent: Jul. 9, 1996

[54] THERMAL PRINTER FOR PRINTING LABELS

[75] Inventors: Heidrun Krug, Wiesenbach; Jürgen Kunert, Rothenberg; Jürgen Schoon, Eberbach; Horst Walter, Neckarsteinach, all of Germany

[73] Assignee: Esselte Meto International Produktions GmbH, Hirschhorn/Neckar, Germany

[21] Appl. No.: 79,121

[22] Filed: Jun. 17, 1993

[30] Foreign Application Priority Data

Jun. 19, 1992 [DE] Germany ..... 42 20 003.2

[51] Int. Cl.[6] ..... B41J 2/36; B41J 2/365

[52] U.S. Cl. ..... 346/100; 347/193; 347/194

[58] Field of Search ..... 347/188, 193, 347/194; 400/120.09, 120.13, 120.14; 156/384

[56] References Cited

U.S. PATENT DOCUMENTS

| | | | |
|---|---|---|---|
| 4,511,903 | 4/1985 | Miyazaki et al. | 347/193 |
| 4,746,931 | 5/1988 | Okuda | 347/193 |
| 5,085,529 | 2/1992 | McGourty et al. | 400/708 |

FOREIGN PATENT DOCUMENTS

| | | |
|---|---|---|
| 0107434 | 5/1984 | European Pat. Off. . |
| 0254454 | 1/1988 | European Pat. Off. . |
| 0440237 | 8/1991 | European Pat. Off. . |
| 56-13193 | 4/1981 | Japan . |
| 58-193170 | 2/1984 | Japan . |
| 0059476 | 4/1984 | Japan . |
| 63-4971 | 6/1988 | Japan . |
| 1-262176 | 1/1990 | Japan . |

*Primary Examiner*—Huan H. Tran
*Attorney, Agent, or Firm*—Nils H. Ljungman and Associates

[57] ABSTRACT

A thermal printer is equipped with apparatus for allowing the thermal printer to be quickly and easily adapted to the type of paper currently being used without the need for testing and adjusting to obtain an essentially optimum print quality. The printer can also be equipped with a temperature sensor, attached to the thermal print head and connected to the computer control to essentially also produce printed images of uniformly high quality regardless of temperature fluctuations of the thermal print head. The necessary information for providing the adjustment values for producing the high quality print can be stored in a read/write memory connected to the processor. Thus, for each thermal print head temperature, there can be a reference energy value which determines the amount of thermal energy to be generated by the heating elements, whereby the processor, after measuring the thermal print head temperature, selects a reference energy value corresponding to the temperature, and transmits it to the control circuit of the thermal print head.

20 Claims, 2 Drawing Sheets

THERMAL PRINTER FOR PRINTING LABELS

BACKGROUND OF THE INVENTION

1. Field of the Invention

The present invention generally relates to a thermal printer for printing labels and a method for printing labels therewith. Such labels can generally be, for example, labels for being applied to shelves for identifying the material present as would be used in warehouses, or labels including pricing information as would be used in grocery stores. Such labels may also have an adhesive backing for being applied to surfaces, or could be standard paper which could be fastened by other application means. More particularly, the present invention relates to apparatus for essentially automatically adjusting the print of a thermal printer during printing of such labels, and the method for adjusting the print. Thermal printers of the type utilized by the present invention generally have a few basic components as outlined below:

a) a thermal print head with a series of electrically controlled heating elements which are held in contact with a counterpressure roller, whereby a label strip to be printed on can be introduced between the heating elements and the counterpressure roller;

b) devices to hold a payoff reel and a takeup reel for a thermal transfer ink ribbon which can be introduced by means of deflector rollers between the heating elements and the label strip, c) a control circuit connected to the thermal print head to control the thermal printer, and d) a computer processor connected to the control circuit.

2. Background Information

Such thermal printers as broadly described above are widely known. Typically, the thermal print heads used in such thermal printers are designed so that they can print directly on labels consisting of temperature-sensitive paper, and also on labels consisting of conventional paper, wherein, for the latter, a thermal transfer ink ribbon coated with temperature-sensitive ink must also be used.

It is generally known that direct printing on temperature-sensitive paper requires more thermal energy to activate the thermal print head than when printing with thermal transfer ink ribbon. For this reason, when the label material, and thus the printing method are changed, the control circuit of the thermal print head must also be adjusted in accordance with the modified printing conditions. In addition, there are also a large number of different types of thermo-paper, or thermo-labels, which are characterized by a paper-specific temperature sensitivity. For each of these different materials, a good quality printed image can only be successfully achieved if the thermal print head has reached a specified temperature.

In the above-discussed situations, if insufficient thermal energy is applied to the print head, the temperature-sensitive label paper will not be sufficiently darkened, and the image can appear on the label in varying shades of grey. If, on the other hand, the thermal energy applied during printing is too great, the thermal print head will be unable to cool down rapidly to the temperature at which the thermal paper is no longer discolored, so that parts of the paper which are not to be printed can also be discolored when they come into contact with the thermal print head, thus "smearing" the image. In the past, the adaptation of the thermal print head control to the type of paper used has essentially been done manually, and essentially has to be repeated every time the paper is changed. Further, each adjustment of the print head control can generally require several time-consuming tests and adjustments, until the image produced by the thermal printer on the labels is of an appropriate print quality.

On known thermal printers as discussed above, after the adjustment of the thermal print head control for the type of paper being used, no consideration is typically given to the fact that the thermal print head can assume different temperatures. It has been determined that, with higher temperatures of the print head, possibly due to climatic temperature fluctuations or to the heat generated by the thermal printer itself, etc., less thermal energy can be used to activate the thermal paper. Such temperature fluctuations can therefore significantly reduce the print quality of the thermal printer as excess heat could be generated thereby "smearing" the image.

OBJECTS OF THE INVENTION

The object of the invention is thus to create a thermal printer which can be quickly and easily adjusted to the type of paper being used, and which can produce printed images of uniformly high quality regardless of any temperature fluctuations of the thermal print head. It is a further object to provide an associated method for performing the necessary adjustments.

SUMMARY OF THE INVENTION

These objects can essentially be achieved by a thermal printer according to the present invention wherein a combination of different components can be utilized to provide the desired results. One of these components can preferably be a temperature sensor disposed adjacent to, or attached to the thermal print head and connected to the computer processor for monitoring and adjusting for any temperature variations. Further, a read/write memory can be connected to the processor for the storage of any information which might be considered relevant to the printing process. For example, information that is to be printed on a label can be stored in a first portion of this memory area, while a second portion of the memory area can be provided for the storage of a data matrix relating to the various types of paper of the label strip which can be printed upon. One of the values which can be stored in this second memory area would preferably be a reference energy value that corresponds to each thermal print head temperature value. The magnitude of this reference energy value can essentially determine the amount of thermal energy to be generated by the heating elements. The processor, after measuring the temperature of the thermal print head, can then preferably select the reference energy value corresponding to this temperature value and can transmit this value to the control circuit to provide a correct current for activating the thermal printer.

In addition, in order to better achieve the object of the invention, the thermal printer could be provided with a data input device connected to the read/write memory, thus enabling the requisite information to be stored in memory, while also allowing for future information to be added, or adjustments to be made as such become necessary.

During the installation of the thermal printer, a data matrix representative of any type of paper to be used for the label strip to be printed on can be entered into the read/write memory by means of the data input device. Thus, when a new label strip is inserted into the printer, the data matrix specified for that type of paper can preferably be either manually activated or even automatically retrieved from the read/write memory, thus enabling the thermal print head to be adjusted to the printing method being used (direct thermal printing or thermal transfer printing), the type of paper being used, and the temperature of the thermal print head, without the requirement for any time-consuming adjustments.

The read/write memory can also be provided with a third memory area to preferably store a specified printing speed. Thus, if the reference energy values in the second memory area are a function of both the thermal print head temperature values and also of the printing speeds, the amount of thermal energy generated during printing and controlled by the processor can also preferably be adapted to the selected printing speed.

To make certain that the thermal transfer ink ribbon has always been inserted when it is necessary to print conventional paper labels, and further, to ensure that the ink ribbon used is particularly well-suited for certain types of paper, it is preferably advantageous if the thermal printer is provided with an ink ribbon sensor connected to the processor. This ink ribbon sensor would preferably detect the presence and/or identify the type of ink ribbon used. The read/write memory could also be provided with a fourth memory area to store data corresponding to the types of ink ribbons, if any, which need to be used for the type of paper being used for the strip of labels. This data could then provide information on which ink ribbon, if any, is necessary to print the selected label strip material. The processor could then preferably verify, on the basis of the ink ribbon data and the information supplied by the ink ribbon sensor, whether an ink ribbon is required for the label strip which has been introduced, and whether the correct ink ribbon is being used.

The ink ribbon sensor could preferably be designed as a laser scanner for reading data characterizing the ink ribbon, which data could preferably be applied in the form of a bar code to a cassette used to hold the ink ribbon. With such a scanner, an accurate, reliable and widely-used technology can be employed to realize the ink ribbon sensor.

An optical data output medium, preferably having an LCD screen, could also be connected to the processor. This output medium could be used, for example, for a menu-driven dialogue to manually control and adapt the thermal printer. For example, the types of paper stored as data matrices in the second memory area can preferably be displayed on the LCD screen, which means that the type of paper inserted in the thermal printer and thus the data matrix corresponding to this type of paper can be manually selected by means of the data input device.

A paper sensor could also preferably be connected to the processor to preferably detect the presence and/or the type of the label strip used. Such a paper sensor would essentially make it possible, on the one hand, to check whether the label strip has been inserted when the printing begins, or if, during the printing, the label strip on the payoff reel has been used up. On the other hand, such a sensor could also preferably make possible a fully-automated printing operation. This would essentially be made possible since the processor, on the basis of the data supplied by the paper sensor, can essentially automatically select the data matrix and the preferred ink ribbon data stored in the read/write memory for the label strip being used.

In this case, too, a widely-used and reliable technology could preferably be used. For example, the paper sensor could be configured as a laser scanner, which could preferably read markings on the labels. As discussed above, such markings could essentially be in the form of bar codes which identify the type of paper being used.

To input the print data and the data necessary for the control of the thermal printer into the read/write memory, a computer keyboard, a card reader, or essentially any other input device, such as a scanner, or any combination of input units can essentially be advantageously used as the data input device.

The control processes could also be accelerated if the processor did not have to retrieve information from the read/write memory for each control process. Therefore, a working memory could be provided, into which working memory can preferably be read, when printing begins, the data matrix corresponding to the type of paper of the label strip being used and the corresponding ink ribbon data.

In summary, one aspect of the invention resides broadly in a thermal printer for printing labels on a label material, the thermal printer comprising print means; a plurality of printing elements disposed on the print means, the printing elements being configured to be thermally heated to print a label; means for storing label material to be printed on; means for providing label material to be printed on from the means for storing label material to an area adjacent the printing elements; means for actuating ones of the printing elements to heat the ones of the printing elements to print a label; means for determining the type of label material to be printed on; and control means for automatically adjusting the actuating means to control the printing elements as a function of the type of label material to be printed upon.

Another aspect of the invention resides broadly in a thermal printer for printing labels on a label material, thermal printer comprising a print head; a plurality of printing elements disposed on the print head, the printing elements being configured to be thermally heated to print on a label; means for providing label material to be printed on to an area adjacent the printing elements; means for determining the type of label material; means for providing an amount of energy to ones of the printing elements to heat the ones of the printing elements to print on the label; and control means for automatically adjusting the means for providing an amount of energy to vary the amount of energy provided to the ones of the printing elements as a function of the type of label material being printed upon.

Yet another aspect of the invention resides broadly in a method for automatically adjusting a thermal printer to print labels on a label material, the printer having a print head, a plurality of printing elements disposed on the print head, the printing elements being configured to be heated to print on a label, means for providing label material to be printed on to an area adjacent the printing elements, means for determining the type of label material; means for providing an amount of energy to ones of the printing elements to heat the ones of the printing elements to print on the label, and control means for automatically adjusting the means for providing an amount of energy to vary the amount of energy provided to the ones of the printing elements as a function of the type of label material being printed upon, and the method comprising the steps of providing label material to be printed on to an area adjacent the printing elements; determining the type of label material; providing an amount of energy to ones of the printing elements to heat the ones of the printing elements to print a label; and automatically adjusting the means for providing an amount of energy to vary the amount of energy provided to the ones of the printing elements as a function of the type of label material being printed upon.

BRIEF DESCRIPTION OF THE DRAWINGS

One embodiment of the present invention is explained below in greater detail, with reference to the accompanying figures, in which.

DESCRIPTION OF THE PREFERRED EMBODIMENTS

Figure 1:
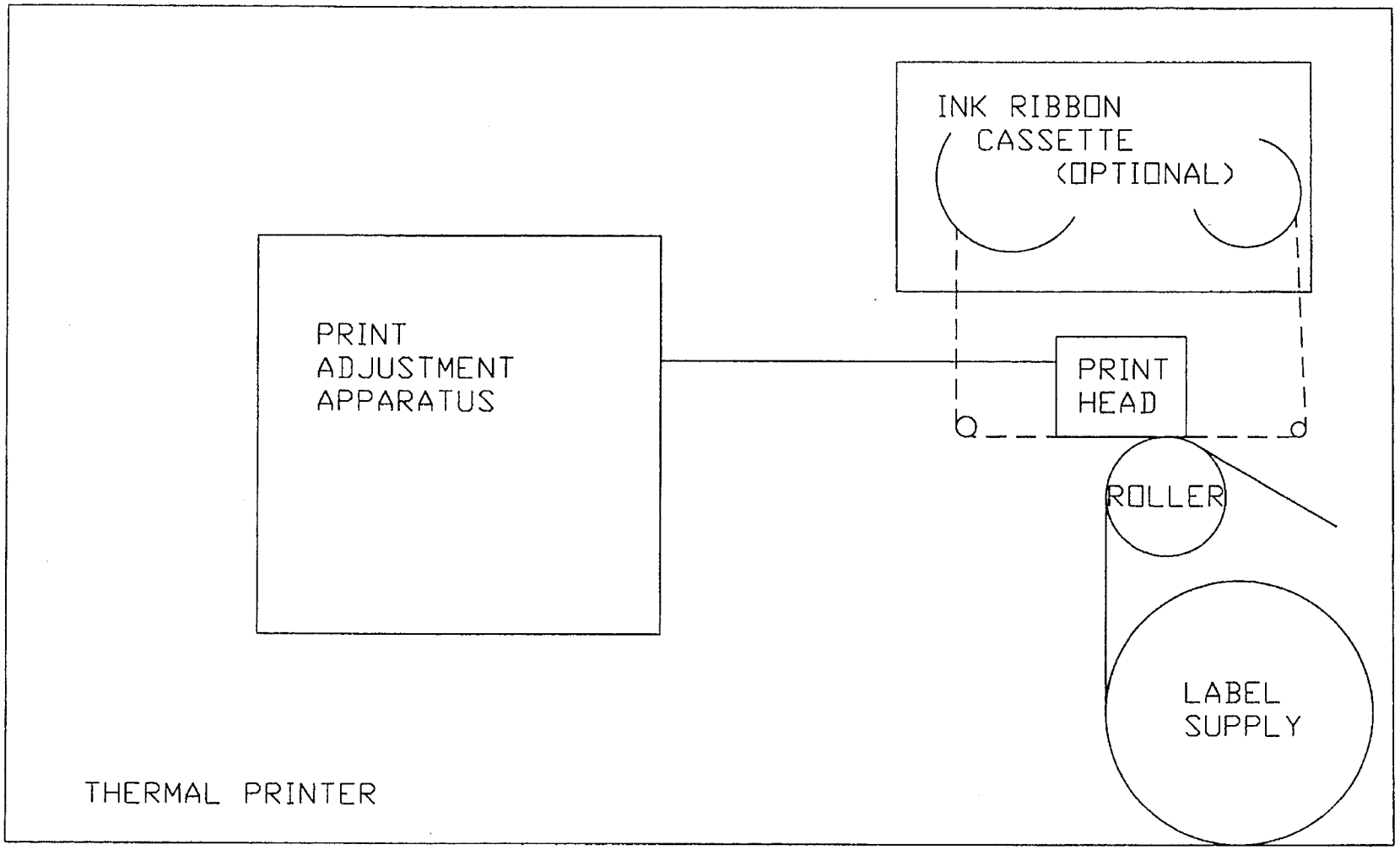
FIG. 1 shows a general diagram of a thermal printer.

The thermal printer 1 illustrated in the figures preferably has a thermal print head 2 which can be electrically connected by means of a control circuit 3 to a computer processor 4. On the underside of the thermal print head 2 there are preferably electrically activated heating elements 5, which can be maintained in contact against a counterpressure roller 6. Preferably, the heating elements 5 can be oriented in a straight line lying perpendicular to the plane of the drawing and aligned with a longitudinal axis of the counterpressure roller 6.

A label strip 7 can be introduced between the heating elements 5 and the counterpressure roller 6. As the label strip 7 is printed, it is preferably unrolled by means of a label strip payoff reel 8. After having been printed with the desired printing information, the label strip can be output by means of an outlet opening 9 of the thermal printer 1. The above described thermal printer apparatus, including the print head, the heating elements and the label strips, are generally known in the art and are not described in further detail herein.

The label strip 7 can consist of temperature-sensitive paper which is printed as it is moved past the pin-shaped heating elements 5. Appropriate ones of the heating elements are heated as necessary, and the areas of the paper to which heat is applied are thereby darkened at the desired points. Alternatively, the label strip 7 can also be conventional writing paper. With such conventional writing paper, it is generally necessary to introduce a thermal transfer ink ribbon 10 between the label strip 7 and the heating elements 5 of the thermal print head 2. The thermal transfer ink ribbon 10 can essentially be coated with temperature sensitive ink, which is configured to melt at the points where it is moved past activated, or heated, heating elements 5. The melted ink then can adhere to the conventional label strip 7 to thereby form a desired printed image.

Such a thermal transfer ink ribbon 10 can preferably be housed in a cassette 11, which cassette 11 can preferably have a payoff reel 12 and a takeup reel 13 therein. The cassette 11 can generally be positioned within the thermal printer 1 by means of devices 14, 15 which are configured to fit into, or hold the reels 12, 13. The thermal printer can also preferably have deflector rollers 16, and 17 disposed within the printer housing, to direct the path of the ink transfer ribbon past the print head 2 and heating elements 5. Such deflector rolls 16, 17 essentially make certain that the thermal transfer ink ribbon 10 is moved past the heating elements 5 at the optimum angle for transferring the ink to the paper in which it is in contact at the print head 5. Such thermal transfer ink ribbons, and the manner of transferring the ink thereon, are also considered to be well known in the art.

The thermal print head 2 can be equipped with a temperature sensor 18 to transmit an analog electrical signal corresponding to the temperature of the thermal print head 2 to an analog-digital (A-D) converter 19. This A-D converter can then digitize the temperature signal and transmit the digitized signal to the processor 4.

The processor 4 can also preferably be connected to a paper sensor 20, which can be, for example, a photoelectric cell which detects the presence of a label strip 7, and reports the presence or absence of a strip to the processor 4. Alternatively, the paper sensor 20 can also be configured as a laser scanner which is capable of reading bar codes. If such a scanner were to be used, bar code markings, indicative of the type of paper being used, could be provided on the paper strips. The bar code markings on the label strip 7 could then be automatically read by the scanner to provide the processor 4 with information not only about the presence of the label strip material, but also about the type of label strip material present. These data can be retrieved by the processor 4 for further processing.

The processor 4 can also preferably be electrically connected to an ink ribbon sensor 21. This ink ribbon sensor 21 can be designed either as a photoelectric cell only to detect the presence of the thermal transfer ink ribbon 10, or, as discussed above for the paper sensor, can be designed as a laser scanner which can read the bar codes applied to the cassette 11, to thereby provide information on the material, or type of thermal transfer ink ribbon 10 being used. Photoelectric cells and laser scanners are essentially well known, and are therefore not described in any further detail herein.

Other types of sensors or scanners, within the skill of the artisan could also be used for detecting the paper or ink ribbon, or alternately scanning information provided on the paper or ink ribbon.

In order to make the thermal printer more "user-friendly", the processor 4 can preferably be connected to an optical data output medium 22. Such an output device 22 could provide an LCD screen 23 for displaying variables which the operator may have to adjust, or to alternately display control commands for operation of the printer. Various alternative output devices would also be within the skill of the artisan.

The processor 4 can also preferably be equipped with a working memory 24, the capacity of which is preferably sufficient to buffer the control data supplied both by the read/write memory 25 connected to the processor 4, and also by the paper sensor 20 and by the ink ribbon sensor 21 during a printing process. The processor 4 can preferably use this information to control the label printer 1. With such a buffer, or working memory 24, the processor could essentially operate at higher speeds as data transfer between the read/write memory 25 and the processor 4 would not need to continuously take place.

Figure 2:
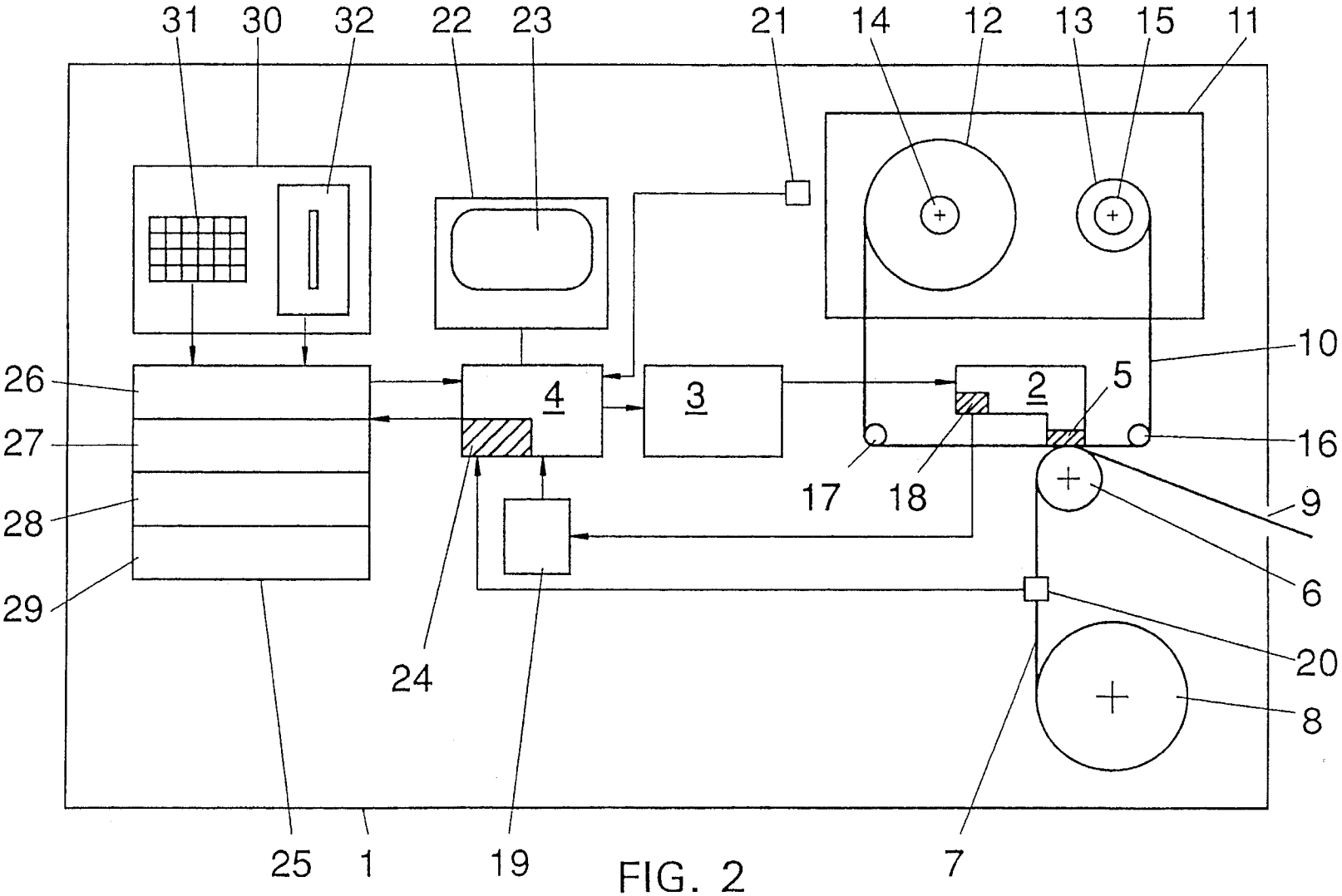
FIG. 2 represents a schematic illustration of a thermal printer with the equipment elements provided for its control.

The read/write memory 25 can essentially be partitioned into several areas depending on the features of the thermal printer. The example shown in FIG. 2 essentially depicts four memory areas 26 to 29, but more or less could be provided, with the possibility for future expansion as needed. The memory areas could be set up as provided below, but the following is meant as an example only, and various other set-ups would be well within the skill of the artisan.

A first memory area 26, could be used to store the information which is to be applied, or printed on the labels. A second memory area 27 could be used to store a data matrix corresponding to the various types of paper which are useable for the label strips 7. A third memory 28 could be used to store the printing speed, that can be set or selected by the operator, and a fourth memory area 29 could be used to store the ink ribbon data corresponding to the various types of paper of the specified label strip 7.

The number of data matrices stored in the second memory area 27 should preferably correspond to the number of types of paper of the label strips 7 which are specified for use on the particular printer. Each of these data matrices is indicative of the type of paper it describes, and can, for example, consist of an array of three rows of data, whereby the data in the first row could indicate the thermal print head temperatures, the data in the second row could indicate the printing speeds, and the data in the third row could indicate reference energy values. During printing, these reference energy values can be transmitted by the processor 4 preferably directly to the control circuit 3 to control the thermal energies to be generated by the thermal print head 2 in each of the individual heating elements 5 to thereby produce an optimized print. For each data pair consisting of a thermal print head temperature and a printing speed, there is preferably a corresponding reference energy value for the paper being printed upon. Thus, when a temperature and a speed value are input, a reference energy value can clearly be determined and output.

The ink ribbon data contained in the fourth memory area 29 could essentially be described as a list consisting of three rows. The data in the first row could indicate the type of paper of the label strip 7 to be used. The data in the second row could have the values 0 and 1, whereby a "0" can means that when the type of paper listed in the first row is being used for printing, no thermal transfer ink ribbon is necessary, and a "1" could indicates that an ink ribbon is necessary for printing. In the third row, there can either be a "0", which can indicate that when a particular type of paper is used, no special requirements need to be set for the material of the thermal transfer ink ribbon 10, or another digit, i.e., 1, 2, 3, etc. could indicate which type of ink ribbon must be used to print the specific type of paper.

The above described data arrays can preferably be read into the read/write memory 25 by means of a data input device 30. Such an input device 30 could essentially be a computer keyboard 31 and a card reader device 32, or in essence could essentially be any type of input mechanism which are commonly used for entering data values into computers, i.e. a scanner.

During the installation of the thermal printer, the data matrices corresponding to the types of paper to be used can be read into the corresponding memory area, or in this example, the second memory area 27. Likewise, the ink ribbon data can be read into its corresponding memory area, or the fourth memory area 29 of the read/write memory 25. Then, when printing is to be done, the data to be printed on the label strip 7 can be input into its corresponding memory area, or the first memory area 26 by means of the input device 30, or computer keyboard 31 and the card reader 32.

The processor 4, via the LCD screen 23, can then preferably output a list of the types of paper that were read into the second memory area 27. The operator can then manually select the data matrix corresponding to the type of paper to be used. Further, the printer may also be set up so that the operator is given an opportunity to verify whether there is a data matrix already stored for the particular type of paper of the label strip 7. Thus, if necessary, the appropriate data matrix can then be read into the corresponding memory area, or second memory area 27 of the read/write memory 25. Alternatively, a label strip 7 of a paper with a data matrix already stored in the memory and displayed on the LCD screen 23 can be introduced into the thermal printer 1.

The processor 4 can then retrieve the data matrix corresponding to the type of paper selected, and can call up the corresponding ink ribbon data from the read/write memory 25, and store these data in its working memory 24.

By means of the LCD screen 23, the processor 4 can output a list of the possible printing speeds contained in the data matrix, and thus enable the operator to select a desired printing speed. If the operator does not select a speed, the processor can automatically default to a predetermined printer speed, which can be, for example, the maximum possible printing speed of the printer. Alternately, if it is known that operation at the maximum speed is not desired, alternative default speeds, such as 50% or 75% of the maximum speed could be entered as the default speed if so desired.

The above described thermal printer 1, thereby provides an opportunity at the beginning of the printing process to select a printing speed, which printing speed can then be stored in the third memory area 28 of the read/write memory 25. After the selected data matrix has been read into the working memory 24, the processor 4 can preferably retrieve the value corresponding to the desired printing speed from the third memory area 28, and compare this value to the speed values contained in the data matrix. The processor 4 can then preferably automatically select the value from the data matrix which either corresponds to, or is closest to the selected printing speed.

By means of the temperature sensor 18, the processor 4 can measure the temperature of the thermal print head 2 and then select, from the data matrix, the temperature value corresponding to, or closest to this value.

From the data matrix, and using the above-chosen temperature and speed values, the processor 4 can then preferably select the reference energy value which is specified for the measured value of the thermal print head temperature and the selected or specified printing speed.

In addition to the above-determinations, the processor can also proceed with determining whether or not an ink ribbon is needed, or what type of ribbon is needed. On the basis of the ink ribbon data read into the working memory 24 and specific to the type of paper, and on the basis of the data supplied by the ink ribbon sensor 21, the processor 4 can then check for the following conditions:

A) whether there is a "1" in the second row of the ink ribbon data (indicating that an ink ribbon is needed), and whether a cassette 11 for the thermal transfer ink ribbon 10 has been inserted; or B) whether there is a "0" in this position and no cassette 11 has been inserted.

If the requirements indicated above are not fulfilled, the processor can be set up to indicate such to the operator by means of an error message, either a visible, or audible warning. The error message could also contain information as to how to correct the problem, for example, either to remove the wrong cassette 11 which has been inserted, or to insert the missing cassette 11.

The processor 4 can also check to see whether there is a "0" in the third row of the ink ribbon data list, or possibly another digit identifying a thermal transfer ink ribbon 10. On the basis of this value and the values supplied by the ink ribbon sensor 21, the processor 4 can check, if necessary, to see whether the correct thermal transfer ink ribbon 10 has been inserted. By means of an error message displayed on the LCD screen 23, or possibly by an audible warning, the operator can preferably be requested to insert the correct thermal transfer ink ribbon 10 into the printer, if necessary.

Finally, on the basis of the data supplied by the paper sensor 20, the processor 4 can preferably check to see whether a label strip 7 has been inserted. A warning signal can also be generated if a paper strip is not present, indicating to the operator that paper needs to be inserted.

The processor 4 can then retrieve the printing information read into the first memory area 26 of the read/write memory 25, and initiate the printing process. To initiate the printing process, the processor 4 will essentially transmit the printing information, the selected or specified printing speed, and the reference energy value selected from the data matrix to the control circuit 3 of the thermal print head 2. The control circuit 3, by means of electrical connections and driver circuits (not shown, but commonly known in the art), can then drive the counterpressure roller 6 to transport the label strip 7, as well as the thermal transfer ink ribbon 10, if any, preferably by means of electric motors, not shown in the figure. The motor for driving the ink ribbon 10 would preferably be connected to the takeup reel 13. The control circuit 3 can also preferably start the printing process itself by activating the individual heating elements 5 as a function of the input and measured data.

The reference energy value determined from the printing speed and the thermal print head temperature essentially then controls the thermal energy generated by the heating elements 5. The thermal energy generated would preferably be greater, the higher the printing speed set and the lower the measured thermal print head temperature. Preferably, the thermal energy can be controlled by changing the times at which a specified voltage is applied to the heating elements. Such heating elements are preferably designed as resistance heating elements.

If the paper sensor 20 is configured as a laser scanner capable of reading bar codes, and if markings are applied to the labels in the form of bar codes which provide information on the type of paper used for the labels, the operation of the thermal printer 1 can essentially be automated because the type of paper for the labels need no longer be input manually by the operator, but the processor 4, by means of the paper sensor 20, can automatically identify which type of labels have been inserted. On the basis of the data received in this manner, the processor 4 retrieves the corresponding data matrix from the second memory area 27 of the read/write memory 25, and the ink ribbon data specified for the type of paper identified from the fourth memory area 29. Using these data, the thermal printer 1 can be controlled by the processor 4 as described above.

One feature of the invention resides broadly in the thermal printer 1 with a) a thermal print head 2 with a series of electrically activated heating elements 5, which are held in contact with a counterpressure roller 6, whereby the label strip 7 to be printed can be introduced between the heating elements 5 and the counterpressure roller 6, b) two devices 14, 15, one each to hold a payoff reel 12 and a takeup reel 13 for thermal transfer ink ribbon 10, which can be transported via deflector rollers 16, 17 between the heating elements 5 and the label strip 7, c) a control circuit 3 connected to the thermal print head 2 to control the thermal printer 1, and d) a processor 4 connected to the control circuit 3, characterized by e) a temperature sensor 18 attached to the thermal print head 2 and connected to the processor 4, f) a read/write memory 25 connected to the processor 4 for the storage of the information to be printed on the labels in a first memory area 26, and by a data matrix for each type of paper of the label strip 7 to be printed in a second memory area 27, in which, for each thermal print head temperature, there is a reference energy value which determines the amount of thermal energy to be generated by the heating elements 5, whereby the processor 4, after measuring the thermal print head temperature, selects the reference energy value corresponding to this temperature and transmits it to the control circuit 3, g) and a data input device 30 connected to the read/write memory 25.

Another feature of the invention resides broadly in the thermal printer, characterized by the fact that the read/write memory 25 has a third memory area 28 to store a specified printing speed, and that the reference energy values in the second memory area 27 are a function both of the thermal print head temperatures and the printing speeds.

Still another feature of the invention resides broadly in the thermal printer, characterized by an ink ribbon sensor 21 connected to the processor 4, which detects the presence and/or the type of the thermal transfer ink ribbon 10 being used, and by the fact that the read/write memory 25 has a fourth memory area 29 for the storage of the ink ribbon data corresponding to the types of paper of the label strip 7.

Yet another feature of the invention resides broadly in the thermal printer, characterized by the fact that the ink ribbon sensor 21 is designed as a laser scanner which reads the data identifying the thermal transfer ink ribbon 10 and the bar code applied to the cassette 1 used to hold the thermal transfer ink ribbon 10.

Still another feature of the invention resides broadly in the thermal printer, characterized by an optical data output medium 22 connected to the processor 4.

Another feature of the invention resides broadly in the thermal printer, characterized by the fact that the optical data output medium 22 has an LCD screen 23.

Still yet another feature of the invention resides broadly in the thermal printer, characterized by the fact that the types of paper stored in the second memory area 27 as data matrices can be displayed via the LCD screen 23, from which the type of paper to be inserted into the thermal printer 1 and thus the data matrix corresponding to this type of paper can be manually selected by means of the data input device 30.

Yet another feature of the invention resides broadly in the thermal printer, characterized by a paper sensor 20 connected to the processor 4 and detecting the presence and/or identifying the type of the label strip 7 used.

Yet still another feature of the invention resides broadly in the thermal printer, characterized by the fact that the paper sensor 20 is designed as a laser scanner which reads markings in the form of bar codes applied to the labels used and identifying the type of paper.

Still another feature of the invention resides broadly in the thermal printer, characterized by the fact that the data input device 30 is in the form of a computer keyboard 31.

Another feature of the invention resides broadly in the thermal printer, characterized by a card reader device 3 as the data input device 30.

Yet another feature of the invention resides broadly in the thermal printer, characterized by the fact that the processor 4 has a working memory 24 into which are read, when printing begins, the data matrix corresponding to the type of paper of the label strip 7 being used and the corresponding ink ribbon data.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A thermal printer for printing on a printing stock, said thermal printer comprising:

thermal print head means for receiving energy and for printing on the printing stock in response thereto;

temperature sensor means disposed adjacent said thermal print head means for measuring and transmitting a signal representative of the temperature in the vicinity of said thermal print head means; and a control circuit for controlling the energy received by said thermal printing head means, said control circuit comprising:

means for receiving a signal representative of a specific printing stock to be printed on selected from a plurality of printing stocks;

means for receiving a signal representative of a specific printing speed selected from a plurality of printing speeds, said plurality of printing speeds being associated with said selected printing stock;

means for receiving said temperature representative signal from said temperature sensor means;

means for generating, from said received selected printing stock signal, said received selected printing speed signal, and said temperature representative signal received from said temperature sensor means, a reference energy value; and means for controlling the energy received by said thermal printing head means according to said reference energy value generated from said received selected printing stock signal, said received selected printing speed signal, and said temperature representative signal received from said temperature sensor means.

2. The thermal printer according to claim 1, wherein said control circuit comprises a microprocessor, and wherein said means for generating said reference energy value comprises memory means, accessible by said microprocessor, for storing data identifying:

at least said specific printing stock selected from said plurality of printing stocks;

said plurality of printing speeds associated with said specific selected printing stock;

a plurality of thermal print head temperatures; and a plurality of reference energy values;

and for correlating said identifying data such that said specific selected printing stock, a specific printing speed selected from said plurality of printing speeds associated with said specific selected printing stock, and a particular thermal print head temperature identify a particular reference energy value.

3. The thermal printer according to claim 2:

said memory means comprising a first memory area for storing information to be printed upon the printing stock to be printed upon;

said memory means additionally comprising a second memory area for storing, in the form of a data matrix, said specific selected printing stock, said plurality of thermal print head temperatures and said plurality of reference energy values; and said memory means having a third memory area for storing said plurality of printing speeds associated with said specific selected printing stock.

4. The thermal printer according to claim 3, wherein said thermal printer additionally comprises:

ink ribbon mounting means for mounting one of a plurality of a thermal transfer ink ribbons, said one mounted thermal transfer ink ribbon for being heated by said thermal print head means and for transferring ink to the printing stock in response thereto; and ink ribbon sensor means for sensing the presence of said mounted thermal transfer ink ribbon being mounted in said ink ribbon mounting means, and for generating an ink ribbon identifying signal indicative of said one mounted thermal transfer ink ribbon mounted in said ink ribbon mounting means;

and wherein said memory means additionally comprises a fourth memory area for storing data identifying each of said plurality of thermal transfer ink ribbons and at least one associated characteristic thereof.

5. The thermal printer according to claim 4, wherein each of said plurality of thermal transfer ink ribbons includes identifying indicia disposed on a surface thereof, and wherein said ink ribbon sensor means comprises laser scanner means for scanning said identifying indicia and for generating said ink ribbon identifying signal indicative of said one mounted thermal transfer ink ribbon mounted in said ink ribbon mounting means.

6. The thermal printer according to claim 5, said thermal printer additionally comprising optical data output means connected to said control circuit for optically displaying at least one of:

data identifying at least one of said plurality of printing stocks;

data identifying a plurality of printing speeds associated with said at least one of said plurality of printing stocks; and data identifying at least one of said plurality of thermal transfer ink ribbons.

7. The thermal printer according to claim 6, said thermal printer additionally comprising data input means for sending to said control circuit signals indicative of:

a selected printing stock; and a selected printing speed.

8. The thermal printer according to claim 7, wherein said thermal printer additionally comprises paper stock mounting means for mounting one of said plurality of printing stocks, and wherein said data input means comprises paper stock type sensor means for determining the presence of said one of said plurality of printing stocks mounted in said paper stock mounting means and for generating and sending to said control circuit a paper stock type signal identifying said one mounted printing stock mounted in said paper stock mounting means.

9. The thermal printer according to claim 8:

wherein each of said plurality of printing stocks includes printing stock identifying indicia on a surface thereof, and wherein said paper stock type sensor means comprises laser scanner means for scanning said printing stock identifying indicia and for sending to said control circuit said paper stock type signal identifying said one mounted printing stock mounted in said paper stock mounting means;

wherein said data input means comprises a computer keyboard; and wherein said thermal printer additionally comprises a working volatile memory for storing said data identifying said specific selected printing stock; said plurality of printing speeds associated with said specific selected printing stock; said plurality of thermal print head temperatures; and said plurality of reference energy values; and wherein said thermal printer additionally comprises card reading means for entering said identifying data into said working volatile memory.

10. The thermal printer according to claim 9:

wherein said memory means comprises a read/write memory;

wherein said thermal print head means comprises a plurality of electrically activated heating elements;

wherein at least one of said plurality of printing stocks comprises a labelling material;

wherein said thermal printer additionally comprises a counterpressure roller for maintaining the paper stock to be printed on in contact with said thermal print head means;

wherein said ink ribbon mounting means comprises a payoff reel for feeding unprinted paper stock to said thermal print head means, a first deflector roller disposed between said payoff reel and said thermal print head means, a takeup reel for receiving printing stock that has been printed on, and a second deflector roller disposed between said thermal print head means and said takeup reel; and wherein said optical data output means comprises a liquid crystal display.

11. A thermal printer for printing on a printing stock, said thermal printer comprising:

thermal print head means for receiving energy and for printing on the printing stock in response thereto;

temperature sensor means disposed adjacent said thermal print head means for measuring and transmitting a signal representative of the temperature in the vicinity of said thermal print head means; and a control circuit for controlling the energy received by said thermal printing head means, said control circuit comprising:

means for receiving a signal representative of a specific printing stock to be printed on selected from a plurality of printing stocks;

means for receiving a signal representative of a specific printing speed selected from a plurality of printing speeds, said plurality of printing speeds being associated with said selected printing stock;

means for receiving said temperature representative signal from said temperature sensor means;

means for generating, from said received selected printing stock signal and said received selected printing speed signal a reference value indicative of a desired temperature of said thermal print head means;

means for comparing said temperature representative signal received from said temperature sensor means with said reference value generated from said received selected printing stock signal and said received selected printing speed signal; and means for controlling the energy received by said thermal printing head means according to the difference between said temperature representative signal received from said thermal print head means and said reference value generated from said received selected printing stock signal and said received selected printing speed signal.

12. The thermal printer according to claim 11, wherein said control circuit comprises a microprocessor, and wherein said means for generating said reference value comprises memory means, accessible by said microprocessor, for storing data identifying:

at least said specific printing stock selected from said plurality of printing stocks;

said plurality of printing speeds associated with said specific selected printing stock;

a plurality of thermal print head temperatures; and a plurality of reference values;

and for correlating said identifying data such that said specific selected printing stock, a specific printing speed selected from said plurality of printing speeds associated with said specific selected printing stock, and a particular thermal print head temperature identify a particular reference value.

13. The thermal printer according to claim 12:

said memory means comprising a first memory area for storing information to be printed upon the printing stock to be printed upon;

said memory means additionally comprising a second memory area for storing, in the form of a data matrix, said specific selected printing stock, said plurality of thermal print head temperatures and said plurality of reference values; and said memory means having a third memory area for storing said plurality of printing speeds associated with said specific selected printing stock.

14. The thermal printer according to claim 13, wherein said thermal printer additionally comprises:

ink ribbon mounting means for mounting one of a plurality of a thermal transfer ink ribbons, said one mounted thermal transfer ink ribbon for being heated by said thermal print head means and for transferring ink to the printing stock in response thereto; and ink ribbon sensor means for sensing the presence of said mounted thermal transfer ink ribbon being mounted in said ink ribbon mounting means, and for generating an ink ribbon identifying signal indicative of said one mounted thermal transfer ink ribbon mounted in said ink ribbon mounting means;

and wherein said memory means additionally comprises a fourth memory area for storing data identifying each of said plurality of thermal transfer ink ribbons and at least one associated characteristic thereof.

15. The thermal printer according to claim 14, wherein each of said plurality of thermal transfer ink ribbons includes identifying indicia disposed on a surface thereof, and wherein said ink ribbon sensor means comprises laser scanner means for scanning said identifying indicia and for generating said ink ribbon identifying signal indicative of said one mounted thermal transfer ink ribbon mounted in said ink ribbon mounting means.

16. The thermal printer according to claim 15, said thermal printer additionally comprising optical data output means connected to said control circuit for optically displaying at least one of:

data identifying at least one of said plurality of printing stocks;

data identifying a plurality of printing speeds associated with said at least one of said plurality of printing stocks; and data identifying at least one of said plurality of thermal transfer ink ribbons.

17. The thermal printer according to claim 16, said thermal printer additionally comprising data input means for sending to said control circuit signals indicative of:

a selected printing stock; and a selected printing speed.

18. The thermal printer according to claim 17, wherein said thermal printer additionally comprises paper stock mounting means for mounting one of said plurality of printing stocks, and wherein said data input means comprises paper stock type sensor means for determining the presence of said one of said plurality of printing stocks mounted in said paper stock mounting means and for generating and sending to said control circuit a paper stock type signal identifying said one mounted printing stock mounted in said paper stock mounting means.

19. The thermal printer according to claim 18:

wherein each of said plurality of printing stocks includes printing stock identifying indicia on a surface thereof, and wherein said paper stock type sensor means comprises laser scanner means for scanning said printing stock identifying indicia and for sending to said control circuit said paper stock type signal identifying said one mounted printing stock mounted in said paper stock mounting means;

wherein said data input means comprises a computer keyboard; and wherein said thermal printer additionally comprises a working volatile memory for storing said data identifying said specific selected printing stock; said plurality of printing speeds associated with said specific selected printing stock; said plurality of thermal print head temperatures; and said plurality of reference values; and wherein said thermal printer additionally comprises card reading means for entering said identifying data into said working volatile memory.

20. The thermal printer according to claim 19:

wherein said memory means comprises a read/write memory;

wherein said thermal print head means comprises a plurality of electrically activated heating elements;

wherein at least one of said plurality of printing stocks comprises a labelling material;

wherein said thermal printer additionally comprises a counterpressure roller for maintaining the paper stock to be printed on in contact with said thermal print head means;

wherein said ink ribbon mounting means comprises a payoff reel for feeding unprinted paper stock to said thermal print head means, a first deflector roller disposed between said payoff reel and said thermal print head means, a takeup reel for receiving printing stock that has been printed on, and a second deflector roller disposed between said thermal print head means and said takeup reel; and wherein said optical data output means comprises a liquid crystal display.

* * * * *